US005326226A

United States Patent [19]

Wyczalkowski et al.

[11] Patent Number: 5,326,226

[45] Date of Patent: Jul. 5, 1994

[54] CONTINUOUS CURVE HIGH SOLIDITY HYDROFOIL IMPELLER

[75] Inventors: Wojciech Wyczalkowski, Harrisburg; John Von Essen, Palmyra; Wojciech Zoladek, Hershey, all of Pa.

[73] Assignee: Philadelphia Mixers Corporation, Palmyra, Pa.

[21] Appl. No.: 68,964

[22] Filed: May 28, 1993

[51] Int. Cl.[5] ..... F04D 29/38; B21H 7/16

[52] U.S. Cl. ..... 416/243; 416/223 R; 416/204 R; 416/DIG. 3; 29/889.3; 29/889.7

[58] Field of Search ..... 416/223 R, 243, DIG. 3, 416/204 R, 213 A; 29/889, 889.3, 889.7

[56] References Cited

U.S. PATENT DOCUMENTS

| | | | |
|---|---|---|---|
| 1,444,923 | 2/1923 | Kempton | 416/243 |
| 1,638,129 | 8/1927 | Parker | 416/243 |
| 2,072,322 | 3/1937 | Upson | 416/204 R |
| 2,460,902 | 2/1949 | Odor | 416/243 |

FOREIGN PATENT DOCUMENTS

| | | | |
|---|---|---|---|
| 294321 | 9/1991 | Fed. Rep. of Germany | 416/223 R |
| 376595 | 5/1973 | U.S.S.R. | 416/223 R |
| 1454277 | 11/1976 | United Kingdom | 416/243 |
| 1543394 | 4/1979 | United Kingdom | 416/DIG. 3 |

*Primary Examiner*—Edward K. Look
*Assistant Examiner*—James A. Larson
*Attorney, Agent, or Firm*—Eckert Seamans Cherin & Mellott

[57] ABSTRACT

A high solidity impeller has a number of equally spaced blades, each formed from a sheet that is bent to a continuous cylindrical curve along a roll axis that lags (in the rotation direction) the radius at which the blade is attached to the shaft. The blade also is pitched by rotation around the radius, i.e., the leading edge is raised in the flow direction and the trailing edge is lowered. The roll axis preferably lags the radius by 45°. This arrangement provides a good approximation of a true hydrofoil and results in an excellent reconciliation between interests of material and manufacturing cost vs. pumping efficiency. The blades can be formed by rolling asymmetrically shaped contours cut from a flat sheet. A base member and preferably a connecting arm couple each blade to the shaft. The base member abuts the rolled contour along surfaces referenced to the roll axis, which surfaces can be used as a reference for rolling. The base member is sufficiently thick to accommodate the continuous curve of the blade, and is preferably welded to the rolled sheet. Although the blade contour is asymmetrical when flat, the roll and pitch preferably place the edges of adjacent blades in common radial planes intersecting the rotation axis, such that the impeller occupies a high percentage of the area of its axial projection.

8 Claims, 6 Drawing Sheets

CONTINUOUS CURVE HIGH SOLIDITY HYDROFOIL IMPELLER

BACKGROUND OF THE INVENTION

1. Field of the Invention

The invention relates to the field of impellers for moving fluids axially relative to a rotating shaft. In particular, the invention concerns a hydrofoil impeller having blades of plate or sheet material defining a section of a cylindrical surface, whereby the blades can be formed by rolling operations. The blades are pitched relative to the axis of the cylindrical surface and relative to the radius of the impeller shaft, and encompass a high percentage of the flow cross section.

2. Prior Art

Various forms of impellers are known for generating an axial flow in a fluid with rotation of one or more impeller arrangements on a shaft. The shape of the impeller blade, and in particular the pitch of the blade as a function of radius, can be subjected to mathematical analysis. At shorter radii, the linear velocity of the blade in the fluid is less than at longer radii. Accordingly, the blade is pitched continuously at a steeper angle adjacent to the impeller shaft and at a shallower angle proceeding radially outwardly.

In addition, there is more area available for the impeller blade at larger radii than at smaller radii. The area, pitch, shape and thickness of the blades, and potentially the shapes of the leading, trailing and radial outside edges, are varied to achieve flow characteristics and other attributes that are desirable in a particular application.

An impeller can be cast with blades of complex shape, pitch and varying thickness. However, this results in a heavy structure. Any cast impeller is expensive, and a large cast impeller may be prohibitively expensive. Costs are reduced by producing the blades separately, and attaching the blades to a hub arrangement on the shaft. The blades can be made from solid plates of uniform thickness, bent to approximate the shape needed for the application. The application may require any combination of axial, rotary, tangential and/or radial flow patterns. The present invention, however, concerns an impeller with curved plate blades, optimized for substantially exclusively axial flow.

U.S. Pat. Nos. 4,147,437 —Jonqueres and 4,468,130 —Weetman teach variations on the shape and character of plate blades for axial flow impellers, generally known as hydrofoil impeller blades. Such impellers are useful for mixing and aerating operations, in particular producing a circulating axially downward flow along the center line of a tank, with an axially upward flow around the periphery. Gas may be sparged into the e.g., below the impeller, where the gas bubbles rise against the axially downward flow. One object of impeller blade design is to obtain the greatest efficiency of fluid movement, which efficiency can be expressed as the volume of fluid moved per unit of power expended to rotate the impeller. Another object of impeller design is to reduce the cost of manufacture without adversely affecting the efficiency of the impeller or the attributes of the impeller for use in its particular mixing application.

U.S. Pat. Nos. 5,046,245 and 4,896,971, both to Weetman et al, concern the design and production of high solidity impellers using plate blades. This form of impeller is useful in sparging applications because the blades, as viewed in plan (axially along the rotation axis), occupy a large proportion of the area in which the impeller rotates, and thus present an obstruction to gas bubbles that rise in opposition to the axial flow.

A plate blade construction presents design challenges related to production efficiency and flow efficiency. The blades are cut from flat plates, and must somehow be formed to obtain the necessary pitch variation, wherein the pitch is steeper adjacent the shaft and shallower proceeding radially outwardly. This would appear to require a complex bending operation. Furthermore, it is advantageous if the curved impeller blade can be attached to the shaft of the impeller using a flat element or blade portion that can be bolted or welded simply, for example to a flat connecting arm or the like that protrudes radially from the impeller hub.

In the foregoing Weetman et al U.S. Pat. No. 5,046,245, an attempt to resolve these apparently conflicting design objects is made by forming an isolated bend along a diagonal of a flat blade, thereby providing flat blade portions with a bend between them. The blade is attached to the impeller hub via a flat connecting arm and a backer plate that attach at one of the flat portions by bolts. This solution is advantageous from a production standpoint in that a flat surface is provided for attachment and the bending operation is straightforward. However, the resulting impeller blade is a poor approximation of the optimal hydrofoil shape. Accordingly, the impeller is not particularly efficient with respect to the volume of fluid moved vs. power expended to rotate the impeller.

SUMMARY OF THE INVENTION

It is an object of the invention to provide an impeller blade with a solid plate of uniform thickness, shaped for high axial pumping efficiency due to a pitch that decreases from the radial inside to the radial outside, and which is shaped by a simple rolling operation applied to the entire blade surface.

It is another object to relate the orientation of an impeller blade and the orientation of a continuous cylindrical bend in the blade, to optimize both the efficiency of the impeller and the ease with which it is manufactured.

It is a further object of the invention to provide a connecting element for an impeller blade as described, wherein the junction between the connecting element and the blade defines a reference surface useful in forming the blade into a continuous curve.

It is also an object of the invention to define an optimal shape of a blade for a high solidity impeller wherein after the blades are curved and mounted, the blade surfaces occupy a high proportion of the area in which the impeller rotates.

These and other objects are accomplished by a high solidity impeller with a number of equally spaced blades, each formed from a sheet that is bent to a continuous cylindrical curve along a roll axis that lags (in the rotation direction) the radius at which the blade is attached to the shaft. The blade also is pitched by rotation around the radius, i.e., the leading edge is raised in the flow direction and the trailing edge is lowered. The roll axis preferably lags the radius by 45°. This arrangement provides a good approximation of a true hydrofoil and results in an excellent reconciliation between interests of material and manufacturing cost vs. pumping efficiency. The blades can be formed by rolling asymmetrically shaped contours cut from a flat sheet. A base member and preferably a connecting arm couple each blade to the shaft. The base member abuts the rolled contour along surfaces referenced to the roll axis, which surfaces can be used as a reference for rolling. The base member is sufficiently thick to accommodate the continuous curve of the blade, and is preferably welded to the rolled sheet. Although the blade contour is asymmetrical when flat, the roll and pitch preferably place the edges of adjacent blades in common radial planes intersecting the rotation axis, such that the impeller occupies a high percentage of the area of its axial projection.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
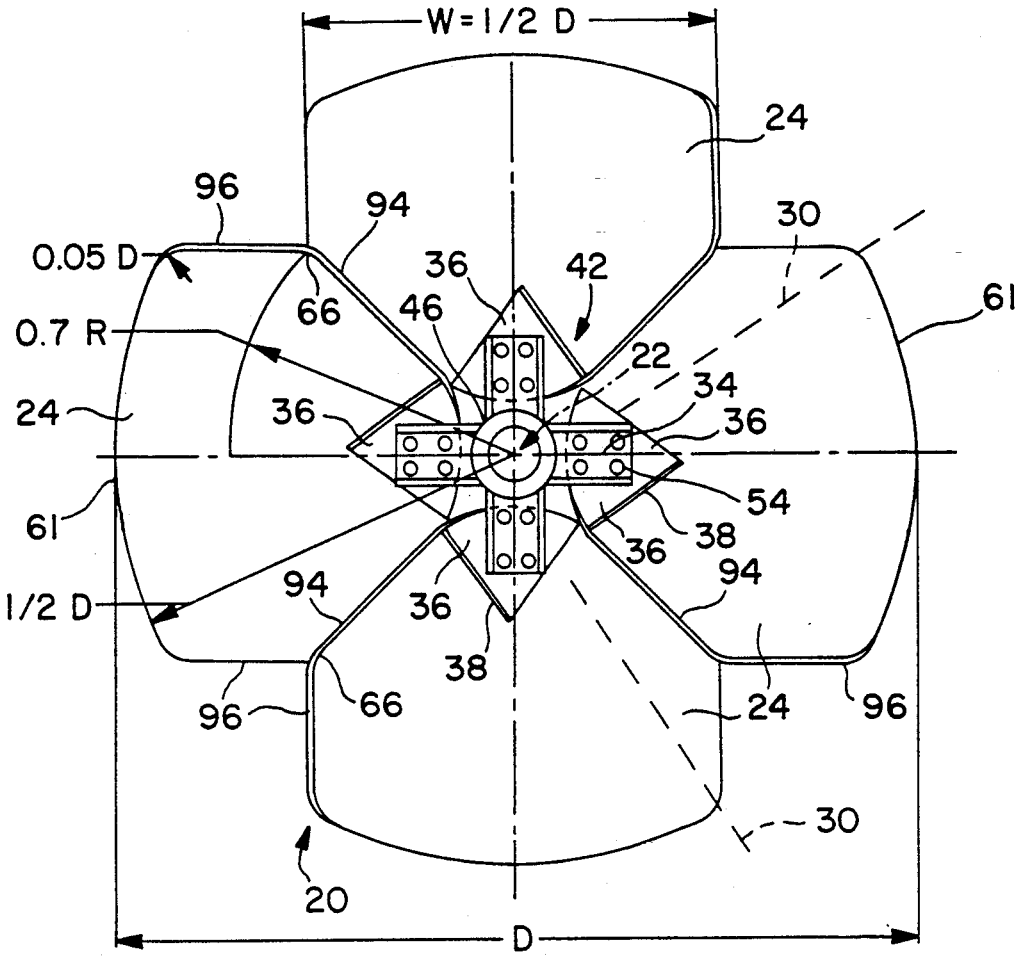
FIG. 1 is a plan view of the impeller according to the invention, viewed along the rotation axis.
Figure 2:
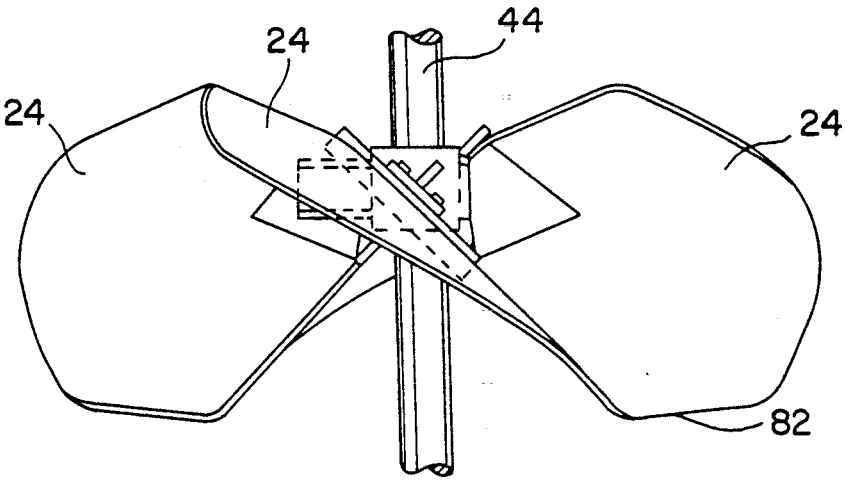
FIG. 2 is a side elevation view of the impeller shown in FIG. 1.

A mixer impeller 20 according to the invention is shown in plan in FIG. 1, i.e., along the axis of rotation 22, and in side elevation in FIG. 2. The impeller 20 produces a large axial flow volume with rotation in a mixing tank or the like (not shown). The projected area occupied by the blades 24 of the impeller 20 in plan view encompasses at least 60% of the area within the outer impeller diameter, and preferably 80 to 90%. Therefore, the impeller 20 produces a high pumping head and is suitable for use for in gas dispersion, solid suspension, high viscosity blending and draft tube applications.

The impeller 20 has a plurality of curved shape blades 24, each essentially comprising plate or sheet material of uniform thickness. Each of the blades 24 defines a cylindrical curve that in the embodiment shown has a bending radius of 1.5 times the impeller radius. The bending axis or roll axis 30 is inclined in two planes relative to the radius defined by the respective connecting arm 34 that fixes the blade 24 to the shaft of the impeller 20. The sheet portions of the blades 24 thus do not have any flat section. However, a base member 36 is welded to each curved blade along a cutout 38, for attachment to a hub 42 that is fixed to the impeller shaft 44. The hub 42 as shown can comprise a central collar 46 having means such as a clamping bolt or weldment (not shown) for attachment to the shaft 44. The connecting arms 34 can be welded to the collar 46.

The base member 36 of the blade 24 is thicker than the plate material 50 of the blade. The base member 36 helps to handle all external forces without damage, provides a means for attachment of the curved blade part 50 to the flat connecting arm 34 protruding radially from the hub 42, and is referenced to the axis of curvature of the blade.

The impeller 20 of the invention is useful in liquid mixing equipment where it is desirable to produce an axial flow. For example, the high solidity impeller shown as an example is particularly applicable to blending, solid suspension, gas dispersion and flocculation processes, as well as for draft tube applications.

Referring to FIG. 1, torque is transmitted from a motor drive or the like (not shown) to the shaft 44. The hub 42 is mounted on the shaft 44 and the blades 24 are attached to the hum 42 by bolts 54. Alternatively, the blades 24 can be attached by welding. Four blades 24 are shown in the exemplary embodiment. A larger number of blades is possible. The preferred minimum of blades is three.

The blade geometry is such that the projected area of the blades 24 as viewed axially along the rotation axis 22 covers at least 60 % and preferably 80 to 90% of the projected area of the circle 61 in which the impeller 20 rotates. The pitch of each blade decreases as a function of radial distance from axis 22. The pitch is greatest adjacent the base 62 of the blades 24, adjacent the shaft 44, and decreases continuously to the tip 63 of the blades 24 at the radial outside. This aspect is shown in the elevation view of FIG. 2. The pitch angle adjacent the hub 42 is preferably between 25° and 45°, and in the embodiment shown is 45°, decreasing to a pitch of about 30° approaching the tip 63.

The outside edge 61 of the impeller 20 is generally circular, i.e., at a radius of half the diameter of the impeller 20. The leading and trailing edges 64, 65, however, are radial only from a point adjacent the base member 36 of the blade 24 to a cusp 66 disposed preferably at a radius of about 0.35 times the impeller diameter (or 0.7 R). From this point outwardly, the leading and trailing edges 64, 65 are substantially parallel to the radius 70 along the connecting arm 34, as viewed axially, and extend to the circular outside edge 61 of the blade 24. The radius of the blade at the corner or junction with the circular outside edge 61 preferably is 0.05 times the impeller diameter.

The blades 24 therefore are relatively wide as compared to their radial extension, making the impeller 20 suitable as a high solidity impeller, particularly adapted for the processes discussed above. The projected blade width (i.e., the width as viewed axially in plan view) is 0.5 times the impeller diameter. It would be possible to make the blades wider, however, as will be apparent from the following discussion, the curve of the blades is such that increasing the blade width by a given width and area, as viewed in plan, requires that a greater area be provided in the stock from which the blade is cut. This is due to the curve of the blades.

Each blade 24 is continuously curved to conform to a section of a right cylinder or tube that is inclined in two planes relative to the radius 70 defined by the respective connecting arm 34 of the blade 24. The blade is attached to the hub 42, preferably at connecting arm 34, by the base member 36. The base member 36 comprises a flat triangular plate that abuts against the complementary triangular cutout 38 in the plate material 50 of the blade 24. The base member 36 is thicker than the blade material 50, and preferably is welded to the blade material. The base member 36 can define a right angle referenced to the axis of curvature of the blade 24, being thereby welded to the blade material 50 along a straight line on one side 72 of the cutout and base member, and along a curved line on the opposite side 74. FIG. 7 illustrates this aspect in a section through FIG. 6.

The impeller 20 is driven clockwise as shown in FIG. 1. The blade material 50 preferably is cut from flat stock and the stock is rolled to form the section of a cylinder. Alternatively, the blade could be cut from a cylindrical tube. Whereas the blade 24 is shaped to this cylindrical contour, the bending operation (or cutting operation) is simple and straightforward, as compared to complex shape forming steps that might seem necessary to provide or to approximate the shape of a cast airfoil type impeller blade. The bending radius of the blade in the embodiment shown is 0.75 times the impeller diameter.

The blade 24 is positioned and attached to impeller 20 at a particular orientation relative to the radius 70 of the impeller 20 through the blade 24. The swiping edge 82 of the blade 24 at the trailing tip is to be the axially lowest point of the blade 24 (assuming a downwardly driven flow in FIG. 2). Thus, in addition to forming a curve in the blade 24, the blade as thus curved is tilted on the radius 70.

Figure 3:
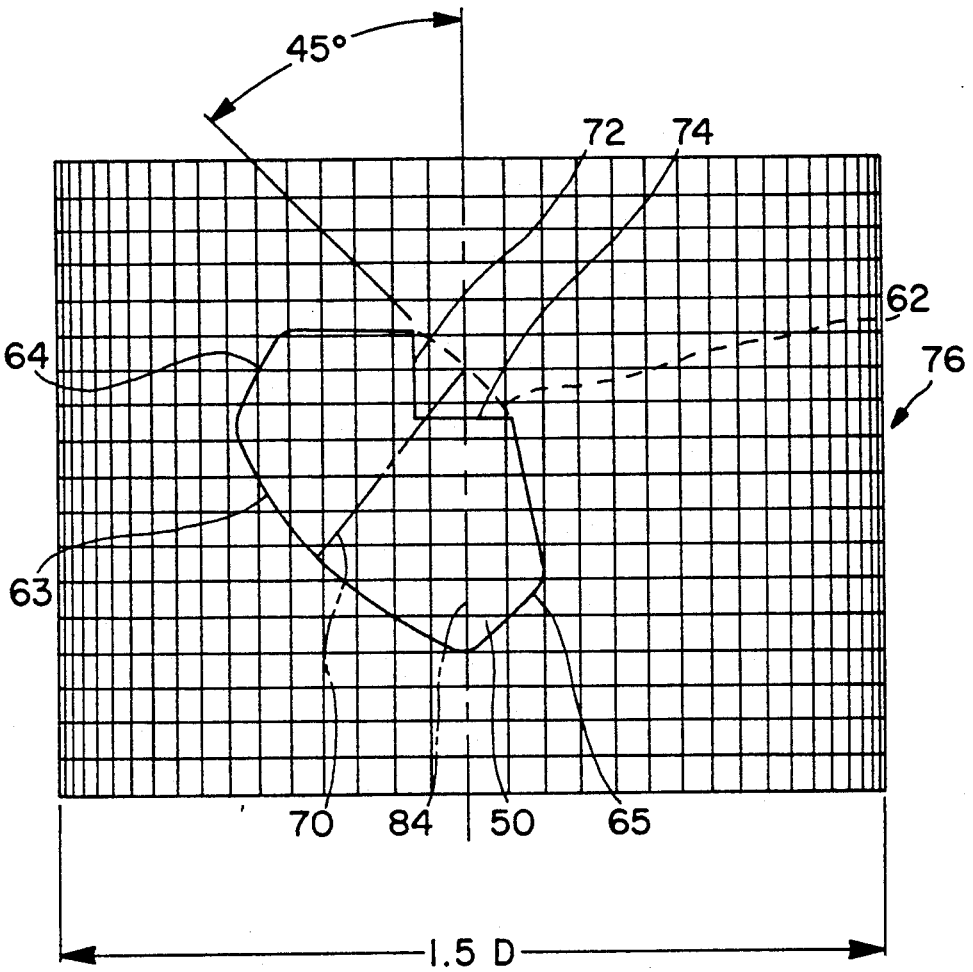
FIG. 3 is a projection of a curved impeller blade plate according to the invention, on a grid representing a cylindrical surface.

FIG. 3 shows the projection of a blade 24 according to the invention on a cylindrical shape, i.e., as bent to the required bending radius or as cut from a tube of the required radius. The plane of the bending axis (or tube axis) intersects the blade along broken line 84. The radius 70 of the impeller as defined by the centerline through the connecting arm 34 is also shown. The plane of the roll axis of the cylindrically shaped impeller blade 24 lags the radius 70 of the impeller 20 through the centerline of the blade 24 in the direction of rotation (See also FIG. 1).

Figure 4:
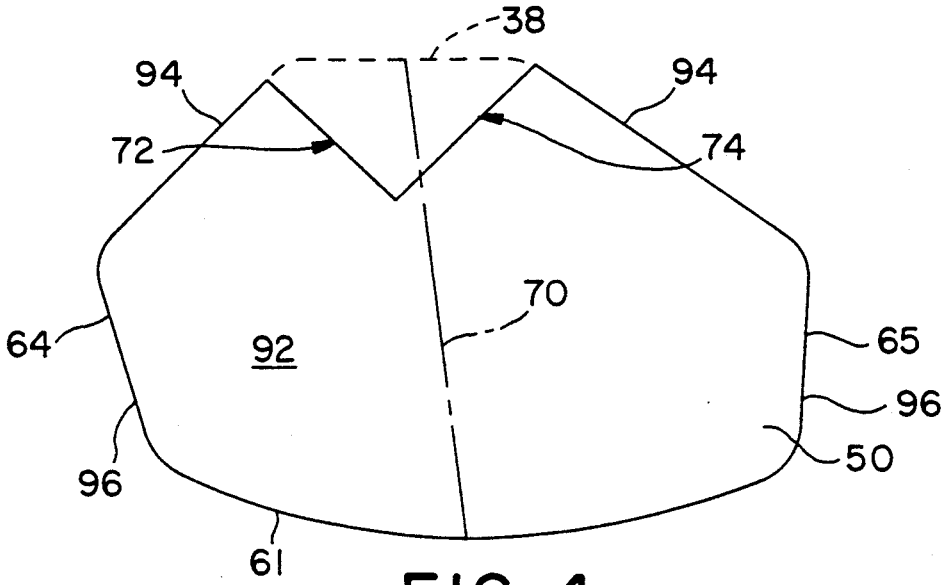
FIG. 4 is a plan view of the blade plate of FIG. 3.
Figure 5:
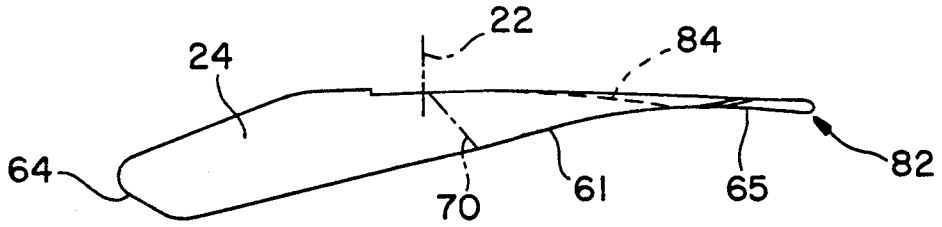
FIG. 5 is a side elevation of the curved blade plate.

FIG. 4 shows the shape of the blade 24 of FIG. 3, with the base 62 (the side facing radially inwardly on the impeller 20) facing upward in the drawing. FIG. 5 is an elevation view showing the same shape on edge. In order to arrange the impeller blade 24 at the correct orientation, i.e., to pitch the blade properly, the blade 24 is rotated around the radius 70 of the impeller 20 such that trailing edge 65 drops to the lowest axial position.

The base member 36 abuts the blade material 50 along edges 72, 74, which preferably join at 90°. Edges 72 and 74 can be cut or marked before rolling, and provide a means of reference during the bending operation. The blade perimeter shape can be cut from flat stock and then rolled, or marked on flat stock which is rolled and then cut to the required shape. Edges 72, 74 are advantageous in that one or both can be rested against a reference abutment in a rolling operation, to place the blade material 50 at the precisely correct orientation in a rolling apparatus. The location of the edges 72, 74 is selected to avoid distortion during bending, in that the bending plane intersects edge 74 at right angles and is parallel to edge 72.

Figure 6:
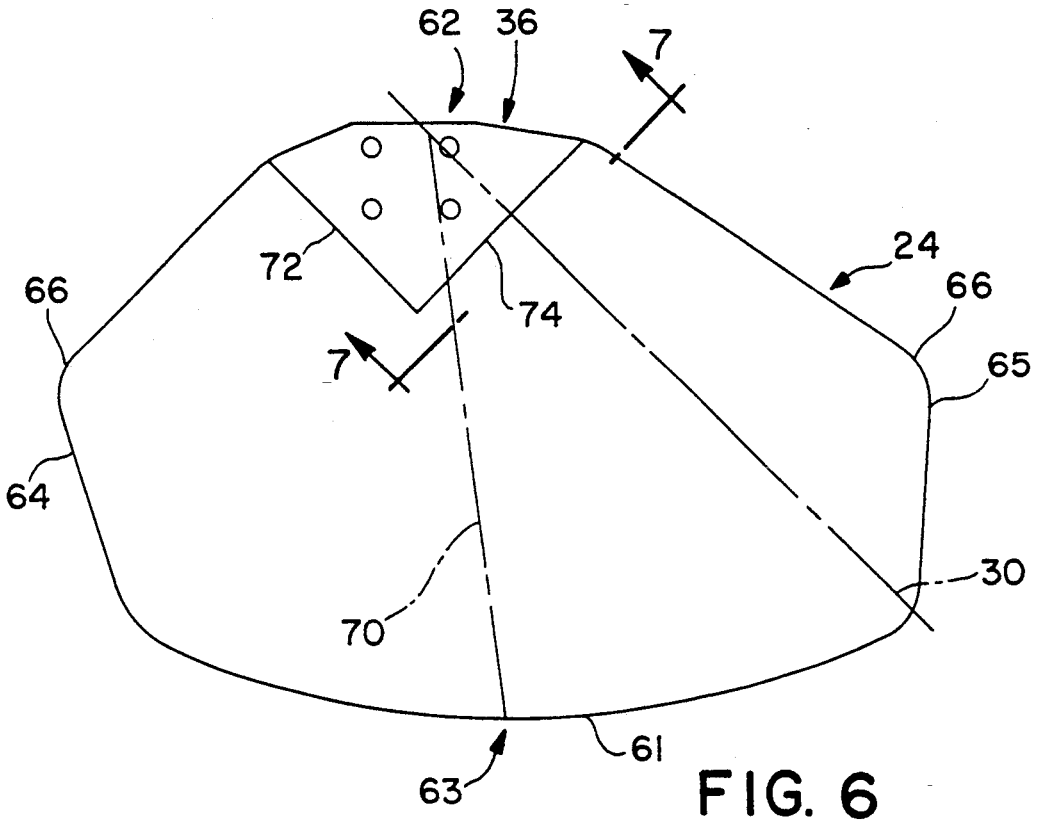
FIG. 6 is a plan view of a blade, including a blade plate and a base element.
Figure 7:
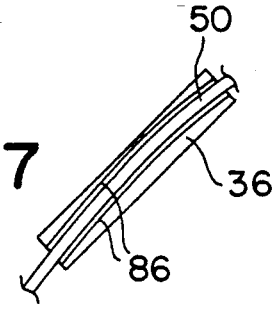
FIG. 7 is a section view taken along line 7—7 in FIG. 6.

The base plate 36 is flat and is welded to the blade after bending as shown in FIGS. 6 and 7. The thickness of the plate 36 is greater than the thickness of the blade material 50 to provide an edge surface on base plate 36 that is thick enough to encompass the bend of the blade 24, preferably with at least minimal space remaining on base plate 36 above and below the blade at edge 74, to accommodate the weld 86 easily. Edge 72 is parallel to the rolling axis, such that the blade abuts the base member 36 along a straight line rather than a curved line as with edge 74, shown in FIG. 7. Along edge 72, the thickness of the blade can be centered between the opposite faces of base member 36.

Figure 8:
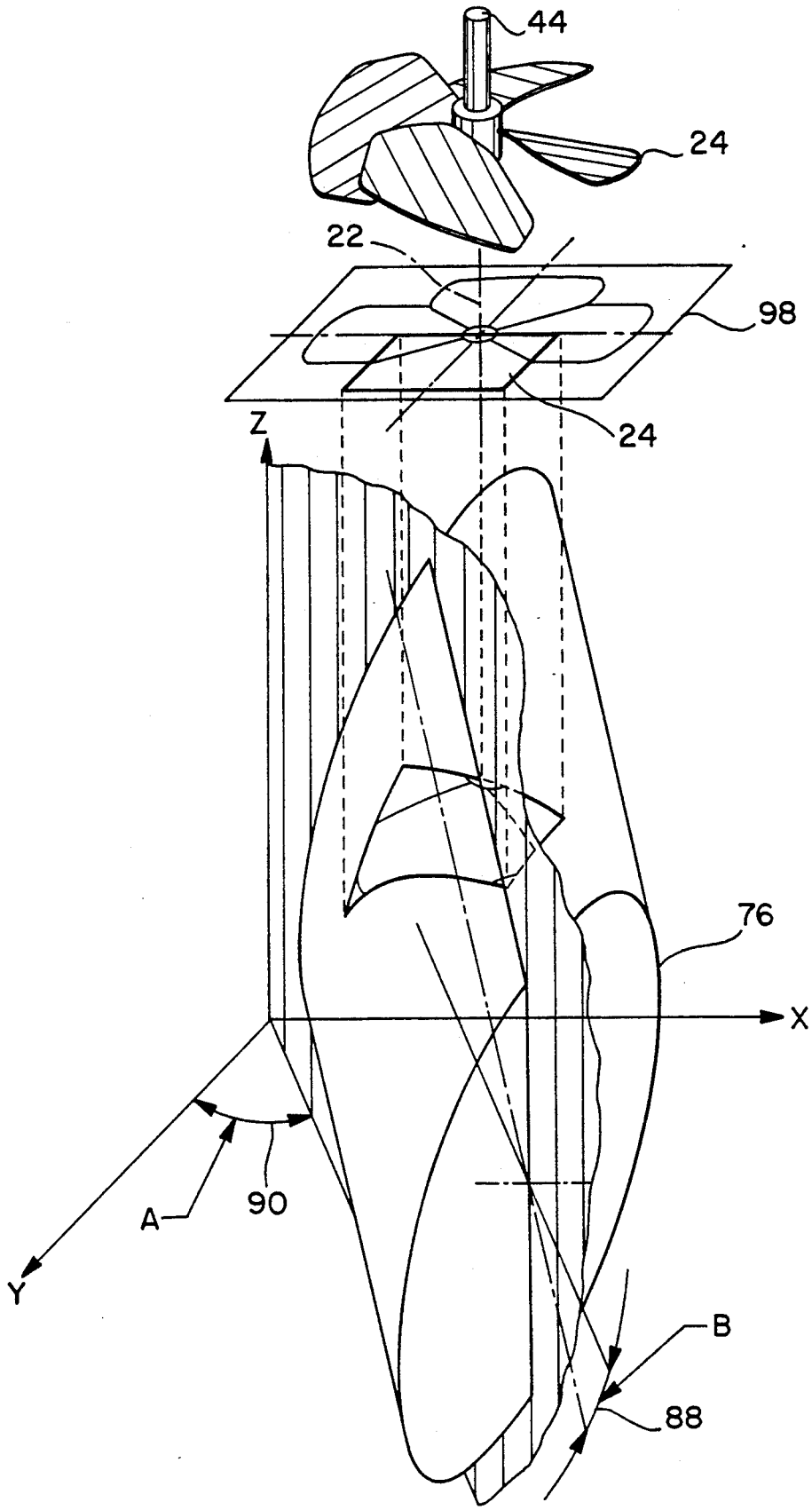
FIG. 8 is a schematic projection view showing the relative orientations of the impeller shaft, the blade roll axis (as represented by a cylindrical surface in which the blade resides), and the blade pitch angle.

The geometry of the blade 24 and its orientation are shown in FIG. 8. The blade 24 is shaped as a section of a cylinder 76, as discussed, and this cylinder is inclined in two planes referenced to the rotation axis 22 of the impeller. The Z axis is parallel to the rotation axis 22, and perpendicular to the plane X-Y (FIG. 8). The roll axis 30 of cylinder 76 is inclined relative to the X-Y plane by a pitch angle 88 or "B" and rotated (offset) relative to the Y axis by angle 90 or "A". The impeller 20 is projected in FIG. 8 onto a plane 98 parallel to the X-Y plane, which shows the area intersecting an axial flow path that is occupied by the impeller. A blade of the impeller is also projected onto the roll cylinder 76, from which the shape and orientation of the impeller blade can be appreciated. The remaining impeller blades are formed in a similar manner.

The pitch angle 88 is the extent to which the blade 24 is tilted relative to the fluid through which it passes. Due to the curve of the blade 24, the pitch of the blade 24 is different at different radial distances from the impeller shaft 44. The pitch angle 88 of the curved blade 24 as a whole is defined herein as the angle between a horizontal plane perpendicular to the impeller shaft 44 and the projection of the axis of the roll cylinder 76 on a plane including the impeller shaft.

The offset angle 90 is the extent to which the projected axis of the roll cylinder 76 angularly lags the radius of the impeller 20 at blade 24 in a radial plane. The offset angle 90 is defined herein as an angle measured in a plane perpendicular to the impeller shaft between a projection of the axis of cylinder 76 (i.e., the roll axis) on this plane and the plane which includes the axis of the shaft and the radial line of the blade 24. The offset angle 90 as shown in FIG. 8 is preferably 45°.

The impeller 20 and its blades 24 are easily manufactured. The preferred process includes forming a blade 24 having a roll axis 30 aligned to lag a radius 70 of the impeller 20 in a rotation direction, setting the pitch of the impeller blade 24 by rotating the formed blade 24 about said radius 70 of the impeller 20, to raise the leading edge 64 of the blade and lower the trailing edge 65, and attaching the blade 24 to the impeller shaft 44 at this roll-offset and pitched shape, orientation and position. The relationship of the curved blade 24 and its pitch and offset are such as to provide elliptical functions along constant radius (circular) cross sections through the blade 24. The curved blade 24 as thus formed has a slope or cross sectional pitch that decreases with increasing radius relative to the impeller rotation axis 22.

A comparison of the flat blade shape 92 (e.g., FIG. 4) and the offset-curved and pitched blade shapes that are presented axially in plan (e.g., as in FIG. 1 or projected on plane 98 in FIG. 8) shows that the optimal flat plate dimensions are asymmetrical with respect to both the radius 70 and the roll axis 84. More particularly, in the flat shape 92, the leading and trailing radial edges 94 are at different angles relative to their respective radial leading and trailing tip edges 96, and are of different lengths. However, when the offset roll and pitch are introduced, the asymmetrical flat form plate 92 of FIG. 4 appears in plan view (FIG. 1) to occupy substantially a regular geometrical segment of the cross section presented axially by the impeller 20. The trailing radial edge section 94 of each blade 24 is substantially axially aligned with the leading radial edge section 94 of the next blade. The outermost leading and trailing edges 96 divert symmetrically from the radial line between the adjacent blades 24. In the four blade embodiment shown, each blade 24 thus occupies a 90° quadrant of the cross section. Similarly, a three blade impeller according to the invention has blades occupying 120°, a five blade impeller has blades occupying 72°, and so forth.

The impeller 20 as described is relatively easy to manufacture in that the offset angle 90 for rolling is readily referenced to the blade shape 92, even though the blade shape is asymmetrical. In particular, the roll axis 84 is referenced to the cutout 38 for the base member 36. The pitch for the blades 24 can be fixed by the angles at which the connecting arms 34 are fixed to the collar 46 or hub 42. Accordingly, the blades 24 are attached at the required offset roll and pitch simply by bolting or welding the base members 36 to the connecting arms 34.

The invention provides high axial pumping efficiency, particularly because the blades 24 define a continuous curve that approximates the complex shape of an airfoil impeller, yet are easily produced. Thus the invention provides an optimal design from the standpoints of materials and production expense vs. operational impeller efficiency.

Figure 9:
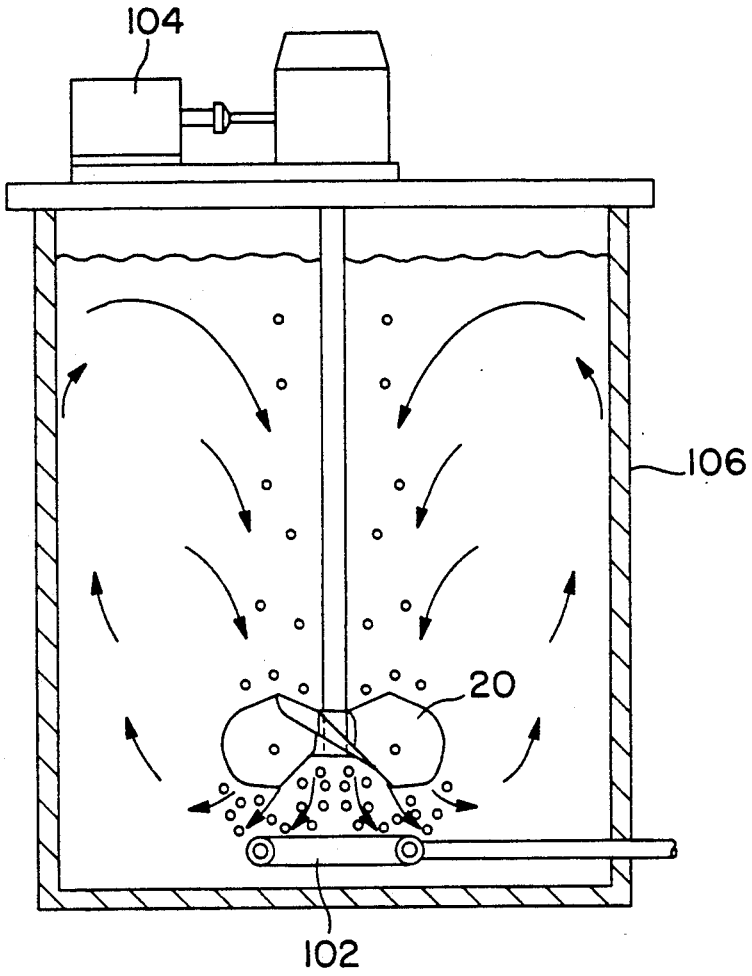
FIG. 9 is an elevation view, partly in section, showing application of the impeller of the invention to a nonuniform flow field mixing/dispersion application.

The impeller as disclosed is particularly advantageous in applications that require good performance with respect to axial flow, mixing/blending efficiency and solids suspension. As a result of the high solidity aspect of the impeller (i.e., the blades occupy a large proportion of an axial projection), the impeller is useful in nonuniform flow field application. Such applications typically involve two phases, e.g., liquid and gas, arranged to flow oppositely. An example is shown schematically in FIG. 9, wherein gas is released at a sparge ring 102 located below an impeller 20, and pumps the fluid-gas mixture downwardly as bubbles of gas seek to rise. The high solidity impeller of the invention assists in dispersion by providing good pumping efficiency, while resisting the tendency of the rising gas to produce an upward flow (leading to flooding, foaming or splashing).

Figure 10:
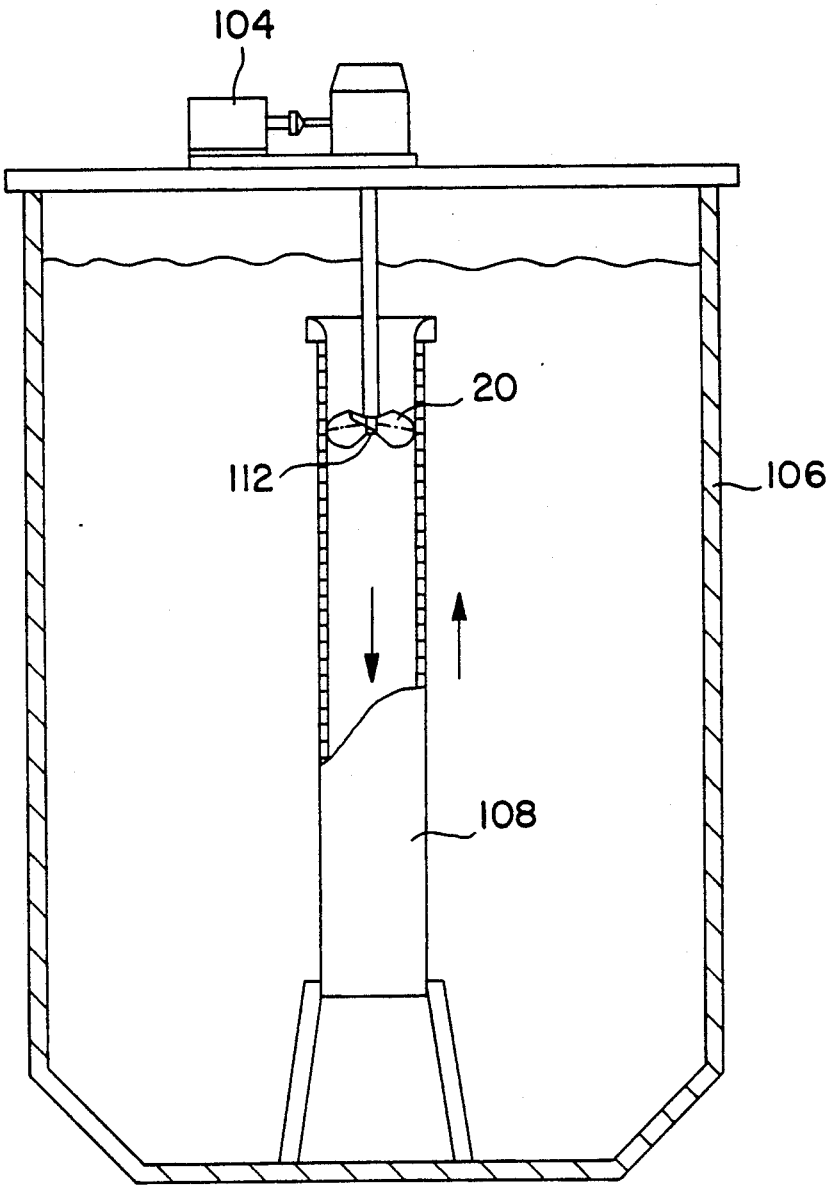
FIG. 10 is an elevation view showing an alternative application, namely a high viscosity flow situation.

The impeller is typically mounted on the free lower end of the shaft, which is rotated by a motor 104 arranged over the tank 106. FIG. 10 illustrates the application of the impeller to a draft tube mixing application. In this arrangement, the impeller produces a downward flow in draft tube 108, and a resulting axially upward flow outside of the draft tube. This application is useful for solids suspension applications. FIG. 10 also illustrates a mounting arrangement for the impeller including a lower support bearing 112, which reduces lateral displacement and oscillation of the shaft. Whereas the high solidity impeller of the invention is heavier than a comparable impeller having blades that do not occupy a large area, it is appropriate where oscillations, lateral displacement due to nonuniform flow fields and the like may be produced, to provide either a lower support bearing, or an upper support that is relatively durable.

In general, whether or not the mixing arrangement has a draft tube, the downward pumping action of the impeller produces a circulating flow, useful in various mixing applications such as fermentation processes and the like. The relatively wide nature of the blades of the preferred impeller has advantageous effects with respect to axial pumping efficiency over a range of viscosities. Most mixing applications are sensitive to axial pumping capacity. In connection with relatively viscous fluids, as well as with suspensions of solids in liquid, the high solidity impeller blades tend to provide a relatively greater exertion of mechanical energy toward axial flow, and less toward localized shear. Thus, the impeller can produce an axial flow in viscous fluids, e.g., above 10,000 to 20,000 centipoise, where many forms of impeller blades would produce localized shear without axial flow.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. An impeller for producing fluid flow in an axial direction relative to a shaft rotating on an axis, comprising:

at least three blades, each said blade being of uniform thickness and extending outwardly along a respective radius relative to the axis of the shaft, each said blade being continuously curved to define a section of a regular cylinder, and having a leading edge and a trailing edge in a rotational direction of the shaft;

said regular cylinder defining a roll axis for each said blade, the roll axis occupying a plane that lags said radius in the rotational direction of the shaft, by an offset angle;

each of the blades defining a pitch angle relative to the radius, such that in the direction of axial flow, the leading edge precedes the radius and the trailing edge follows the radius; and, at least one base member coupling between the blades and the shaft, each said blade and said base member abutting one another along at least one surface disposed at a predetermined angle relative to the roll axis.

2. The impeller according to claim 1, wherein the base member and said blade abut along a surface perpendicular to the plane of the roll axis, said base member being sufficiently thick to accommodate the continuous curve of said blade in a plane perpendicular to the roll axis.

3. The impeller according to claim 1, wherein the base member and each said blade abut along a first surface parallel to the plane of the roll axis and along a second surface perpendicular to the plane of the roll axis, said base member being sufficiently thick along the second surface to accommodate the continuous curve of the blade in the plane perpendicular to the roll axis, said base member and said blade being attached by welding along at least the second surface.

4. The impeller according to claim 3, further comprising a hub attachable to the shaft and a connecting arm coupled between the hub and the base member.

5. The impeller according to claim 4, further comprising means attaching the connecting arm to the base member, and wherein at least one of the connecting arm, the base member and the means for attaching the connecting arm to the base member defines said pitch angle.

6. An impeller for producing fluid flow in an axial direction relative to a shaft rotating on an axis, comprising:

at least three blades, each said blade being of uniform thickness and extending outwardly along a respective radius relative to the axis of the shaft, each said blade being continuously curved to define a section of a regular cylinder, and having a leading edge and a trailing edge in a rotational direction of the shaft;

said regular cylinder defining a roll axis for each said blade, the roll axis occupying a plane that lags said radius in the rotational direction of the shaft, by an offset angle;

each of the blades defining a pitch angle relative to the radius, such that in the direction of axial flow, the leading edge precedes the radius and the trailing edge follows the radius; and a base member coupling between the blades and the shaft, each said blade and the base member abutting one another along a surface parallel to the plane of the roll axis.

7. A method for making an impeller for moving fluid in an axial direction relative to a shaft rotating on an axis, comprising the steps of:

forming a plurality of blades for extending outwardly along a radius relative to the shaft, the blades each being formed from a sheet of uniform thickness, curved to conform to a section of a regular cylinder around a roll axis, the roll axis occupying a plane that lags said radius in a rotational direction of the shaft, by an offset angle, said forming step including cutting the sheet from flat stock, thereby defining a two dimensional contour, and rolling the sheet to conform to said section;

pitching each of the blades about a respective said radius, such that in the direction of axial flow, the leading edge precedes the radius and the trailing edge follows the radius; and, attaching the blades to the shaft, including by affixing the sheet to a base member and coupling the base member to the shaft, the base member abutting the blade along at least one surface referenced to the roll axis and wherein said rolling is referenced to said at least one surface.

8. The method according to claim 7, wherein the two dimensional contour of the flat sheet is asymmetrical relative to the radius, and further comprising defining the two dimensional contour such that each of the blades is substantially symmetrical to said radius in an axial projection of the impeller.

* * * * *